US008739476B1

(12) United States Patent
Royer

(10) Patent No.: US 8,739,476 B1
(45) Date of Patent: Jun. 3, 2014

(54) BUILDING ASSEMBLY KIT WITH ROOF RING

(71) Applicant: David Royer, Norwood, CO (US)

(72) Inventor: David Royer, Norwood, CO (US)

( * ) Notice: Subject to any disclaimer, the term of this patent is extended or adjusted under 35 U.S.C. 154(b) by 0 days.

(21) Appl. No.: 13/920,384

(22) Filed: Jul. 22, 2013

(51) Int. Cl.
*E04B 7/00* (2006.01)

(52) U.S. Cl.
USPC ..... 52/82; 52/93.2; 52/655.2; 135/159; 403/217

(58) Field of Classification Search
USPC ..... 52/200, 93.1, 93.2, 82, 81.3, 655.1, 52/655.2; 135/100, 159; 403/170, 171, 403/172, 217, 218, 219
See application file for complete search history.

(56) References Cited

U.S. PATENT DOCUMENTS

| | | | | | |
|---|---|---|---|---|---|
| 469,638 | A * | 2/1892 | Chase | 52/261 |
| 1,116,244 | A * | 11/1914 | Conner | 52/82 |
| 3,486,278 | A * | 12/1969 | Woods | 52/81.3 |
| 4,245,809 | A * | 1/1981 | Jackson | 249/15 |
| 4,426,814 | A * | 1/1984 | Stuhmer | 52/82 |
| 4,449,843 | A * | 5/1984 | Wendel | 403/173 |
| 4,498,800 | A * | 2/1985 | Sielaff | 403/172 |
| 4,521,998 | A * | 6/1985 | DeLorme | 52/81.3 |
| 4,592,671 | A * | 6/1986 | Daum | 403/171 |
| 4,739,594 | A * | 4/1988 | Langford et al. | 52/82 |
| 4,910,928 | A * | 3/1990 | Cellar, Jr. | 52/82 |
| 5,197,241 | A * | 3/1993 | Romeo et al. | 52/82 |
| 5,896,709 | A * | 4/1999 | Pope | 52/90.1 |
| 6,324,792 | B1 * | 12/2001 | DeGarie | 52/80.1 |
| 6,843,026 | B2 * | 1/2005 | Hoehn | 52/82 |
| 2006/0291952 | A1 * | 12/2006 | Wood | 403/217 |
| 2009/0056239 | A1 * | 3/2009 | Wolfram | 52/81.3 |

FOREIGN PATENT DOCUMENTS

| | | | | |
|---|---|---|---|---|
| FR | 2620481 | A1 * | 3/1989 | E04B 7/00 |

* cited by examiner

*Primary Examiner* — Robert Canfield
*Assistant Examiner* — Babajide Demuren
(74) *Attorney, Agent, or Firm* — Benjamin F. Williams

(57) ABSTRACT

A building assembly kit with roof ring having an open-ended plurality of hollow cuboid tube joints radially disposed around an open center of a roof ring and a plurality of parallelepiped strut members disposed between each of the plurality of cube joints, each of said cube joints and strut members disposed to interconnect endwise with a plurality of extant rafters, said rafters then interconnectable with a plurality of top brackets disposed to interconnect each of said plurality of rafters at a juncture between a pair of horizontally disposed extant wall top beams and a vertically oriented corner post, said corner post connected at a juncture of a pair of base runners at a base bracket, wherein a structure is expediently erected by inserting each rafter, wall top beam, corner post, and base runner into a corresponding tube joint, top bracket, and base bracket.

9 Claims, 6 Drawing Sheets

BUILDING ASSEMBLY KIT WITH ROOF RING

BACKGROUND OF THE INVENTION

Various types of building assembly kits are known in the prior art. However, what is needed is a building assembly kit with roof ring having an open-ended plurality of hollow cuboid tube joints radially disposed around an open center of a roof ring and a plurality of parallelepiped strut members disposed between each of the plurality of cube joints, each of said cube joints and strut members disposed to interconnect endwise with a plurality of extant rafters, said rafters thence interconnectable with a plurality of top brackets disposed to interconnect each of said plurality of rafters at a juncture between a pair of horizontally disposed extant wall top beams and a vertically oriented corner post, said corner post connected at a juncture of a pair of base runners at a base bracket, wherein a structure is expediently erected by inserting each rafter, wall top beam, corner post, and base runner into a corresponding tube joint, top bracket, and base bracket

FIELD OF THE INVENTION

The present invention relates to a building assembly kit with roof ring, and more particularly, to a building assembly kit with roof ring having an open-ended plurality of hollow cuboid tube joints radially disposed around an open center of a roof ring and a plurality of parallelepiped strut members disposed between each of the plurality of cube joints, each of said cube joints and strut members disposed to interconnect endwise with a plurality of extant rafters, said rafters thence interconnectable with a plurality of top brackets disposed to interconnect each of said plurality of rafters at a juncture between a pair of horizontally disposed extant wall top beams and a vertically oriented corner post, said corner post connected at a juncture of a pair of base runners at a base bracket, wherein a structure is expediently erected by inserting each rafter, wall top beam, corner post, and base runner into a corresponding tube joint, top bracket, and base bracket

SUMMARY OF THE INVENTION

The general purpose of the building assembly kit with roof ring, described subsequently in greater detail, is to provide a building assembly kit with roof ring which has many novel features that result in a building assembly kit with roof ring which is not anticipated, rendered obvious, suggested, or even implied by prior art, either alone or in combination thereof.

The present building assembly kit with roof ring has been devised for the expedient erection of a building with a minimum of tools required. A plurality of rafters are radially projected around a centrally disposed roof ring, each of said rafters terminating at a top bracket, there secured at a juncture between a respective pair of wall top beams and a corner post, each corner post thence vertically disposed to terminate at a base bracket at the juncture between a respective pair of base runners, each of said pair of base runners disposed in parallel with a corresponding pair of wall top beams.

The roof ring, each top bracket, and each base bracket are devised to securely integrate a respective rafter, a pair of wall top beams, a corner post, and a respective pair of base runners in a predetermined and arranged structural element, whereby a building is expediently erectable by interconnection of said structural elements with a minimum of tools required.

Starting at the building top, then, the roof ring includes a plurality of wedge shaped facets. Each of said plurality of wedge shaped facets includes an outside face, an inside face, a first edge, a pair of converging edges, and a fourth edge. The fourth edge is shorter in length than the first edge. Each of said plurality is joined together at each converging edge to form a polygonal ring disposed between an upper perimeter (defined by each first edge) and a lower perimeter (defined by each fourth edge). Because the fourth edge of each wedge shaped facet comprising the roof ring is shorter than the respective first edge, the lower perimeter is shorter than the upper perimeter, and each outside face presents a sloped surface disposed between the upper perimeter and the lower perimeter. An open center is thus maintained centrally within the roof ring, between the shorter lower perimeter and the upper perimeter, and each wedge shaped facet slopes inwardly, toward the open center, between said upper and lower perimeters.

Each of a plurality of hollow cuboid tube joints is disposed upon each facet outside face. Each of the plurality of hollow cuboid tube joints includes a top face, a bottom face disposed parallel the top face, and a pair of vertical faces perpendicularly disposed between the top face and the bottom face. A rafter pocket is therefore defined between the top face, the bottom face, and each vertical face, whereby a rafter is insertible endwise into the rafter pocket, to abut the outside face of the particular wedge shaped facet upon which the cuboid tube joint is disposed. The rafter is thus supported at one end, and angularly disposed along a plane sloping downward relative the roof ring.

Each rafter pocket engages a rafter surrounding said rafter on four sides to secure the rafter in position within the rafter pocket and prevent unwanted movement of the rafter relative the roof ring during installation or building construction.

Each of a plurality of parallelepiped strut members is disposed connecting the bottom faces of adjacently disposed tube joints, there disposed to underlie a rafter supported endwise thereon between adjacent tube joints. Because the tube joints are disposed perpendicularly upon each wedge shaped facet outside face, and thereby angled downwardly relative the planes of the upper and lower perimeters, each of the parallelepiped strut members is in a common plane with each respective bottom surface of each tube joint, whereby rafters supported endwise upon each strut member is likewise disposed in a plane sloping downward relative the roof ring, in parallel with rafters disposed in adjacent tube joints. Thus a plurality of rafters is supported endwise by insertion and interconnection with the roof ring in a radial and angled configuration around the roof ring.

A plurality of top brackets is included, to support the plurality of rafters at the other end, at the juncture between adjacently disposed wall top beams. Each of said plurality of top brackets includes a first beam pocket oriented in a horizontal plane and disposed to connect with an end of a wall top beam. A second beam pocket is angularly disposed endwise upon the first beam pocket, for interconnection with a second, adjacently disposed, wall top beam. A pocket juncture is thus disposed between the first and second beam pockets, and a pair of wall top beams are securable in a horizontal plane, at an angle relative each other.

A first rafter connect is disposed atop the first beam pocket proximal the pocket juncture, and a second rafter connect is disposed atop the second beam pocket, proximal the pocket juncture, in parallel with the first rafter connect, whereby a respective rafter abuts the top bracket and is secured thereatop by means of each rafter connect. Each of the first and second rafter connect is a right trapezoid, with a hypotenuse disposed to run parallel the rafter there interconnected.

A vertical beam pocket is disposed perpendicularly underlying the first and second beam pockets at the pocket juncture.

The vertical beam pocket interconnects the respective top bracket with a top end of a respective corner post, said corner post vertically oriented in support of the top bracket, a respective rafter, and each respective wall top beam interconnected in the respective top bracket.

The corner post terminates at the other, bottom end at a base bracket, disposed to interconnect a respective corner post with a pair of base runners, disposed in parallel with a respective pair of wall top beams disposed at top bracket disposed at the top of the respective corner post.

Each base bracket includes a vertically oriented base pocket disposed to interconnect with the corner post bottom end, a first base shoe and a second base shoe. Each of said first and second base shoes is disposed to connect atop the end of a respective base runner over three sides of said base runner. The second base shoe is disposed angularly endwise upon the first base shoe, whereby a respective pair of base runners are disposed in parallel with a respective overlying pair of wall top beams.

It should be evident that the number of the wedge shaped facets may be increased, to render larger structures, or decreased, for smaller structures, when manufacturing a particular roof ring. The number of top brackets and base brackets required is dependent on the number of wedge shaped facets comprising the roof ring, and may vary with any particular roof ring. In all cases, however, the roof ring articulates a radial configuration of rafters for connection at each of a corresponding plurality of top brackets, each top bracket securing each rafter to a pair of correctly oriented wall top beams, a vertically oriented corner post, and a pair of correctly oriented base runners, whereby a structure is conveniently and expediently erectable with a minimum of tools required.

A user simply inserts precut rafters endwise into corresponding rafter pockets. Each rafter is thus positioned appropriately for interconnection with corresponding precut wall top beams and a relevant, precut corner post interconnected, and correctly aligned, in a corresponding top bracket, said corner post thence connected with a pair of pre cut base runners likewise oriented appropriate to integration with adjacent base brackets, whereby an entire structure may be rapidly erected, and secured together, by means of the present building assembly kit with roof ring.

Thus has been broadly outlined the more important features of the present building assembly kit with roof ring so that the detailed description thereof that follows may be better understood and in order that the present contribution to the art may be better appreciated.

Objects of the present building assembly kit with roof ring, along with various novel features that characterize the invention are particularly pointed out in the claims forming a part of this disclosure. For better understanding of the building assembly kit with roof ring, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
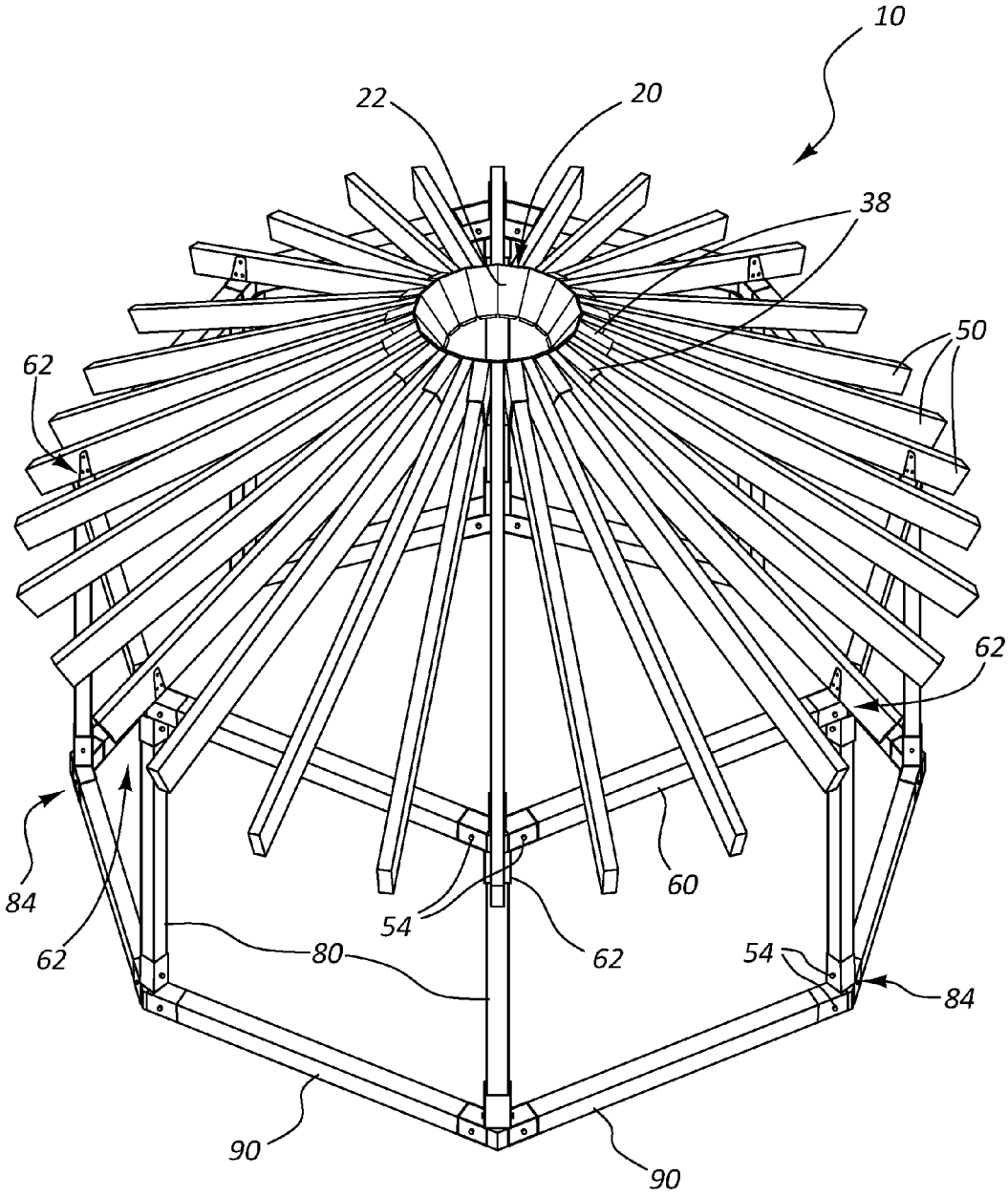
FIG. 1 is an in-use view.
Figure 2:
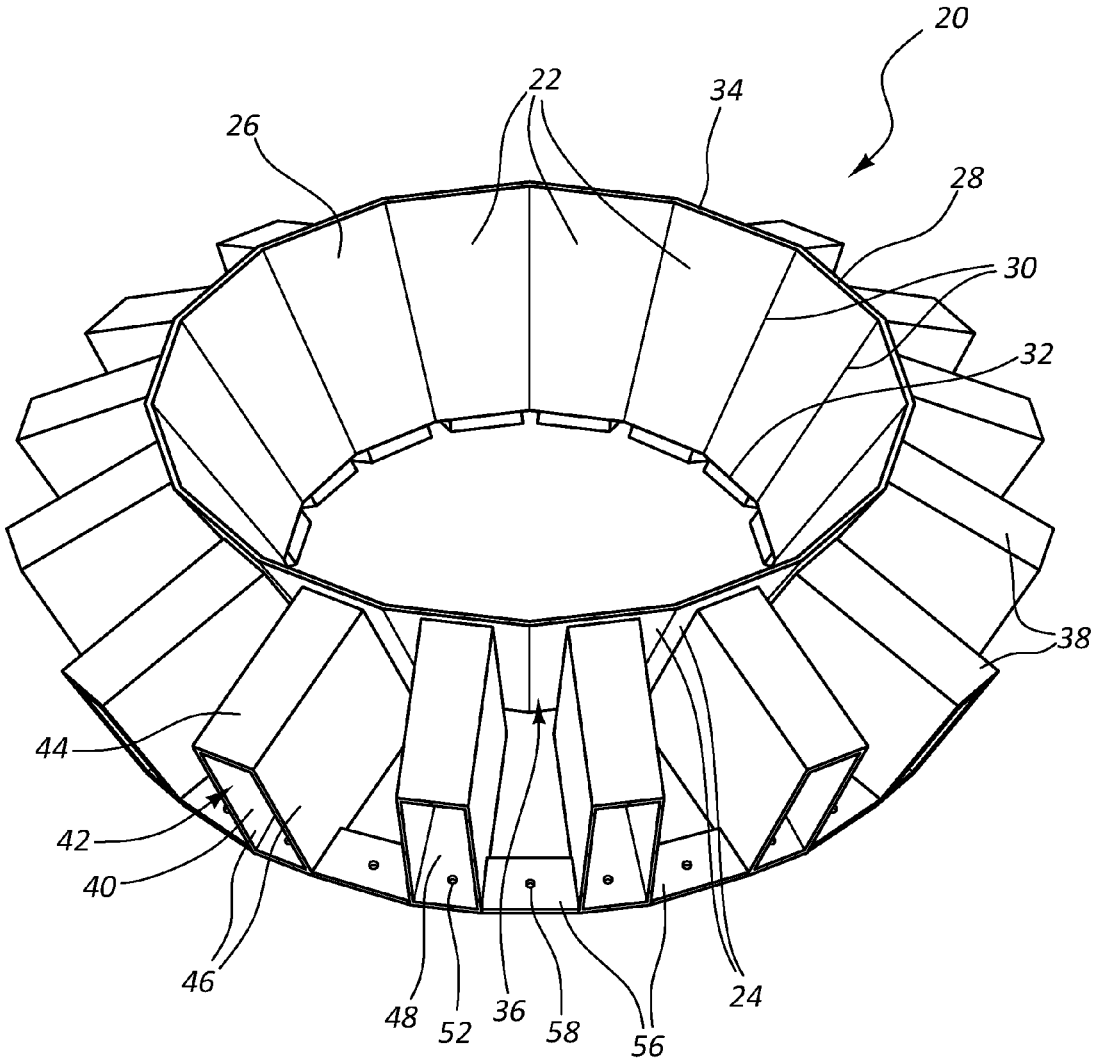
FIG. 2 is a an isometric view of a roof ring.
Figure 3:
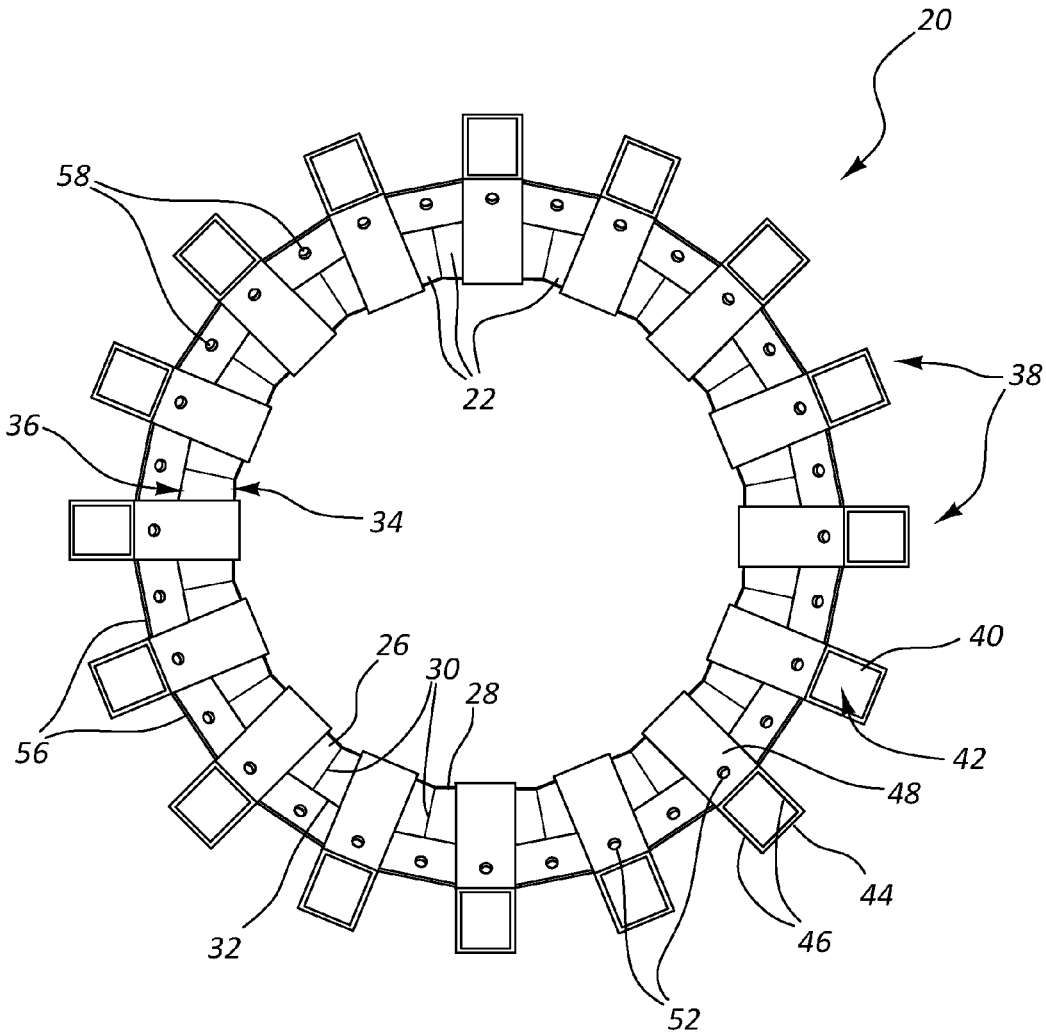
FIG. 3 is a bottom view of the roof ring.
Figure 4:
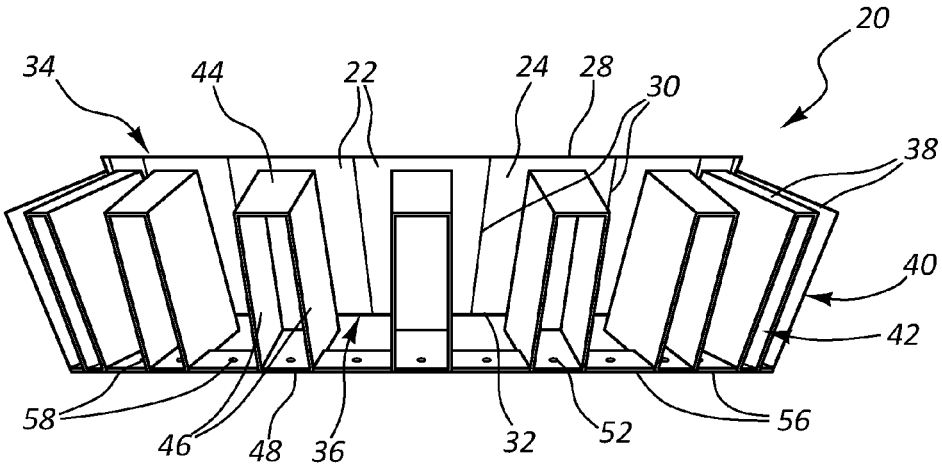
FIG. 4 is a side view of the roof ring.
Figure 5:
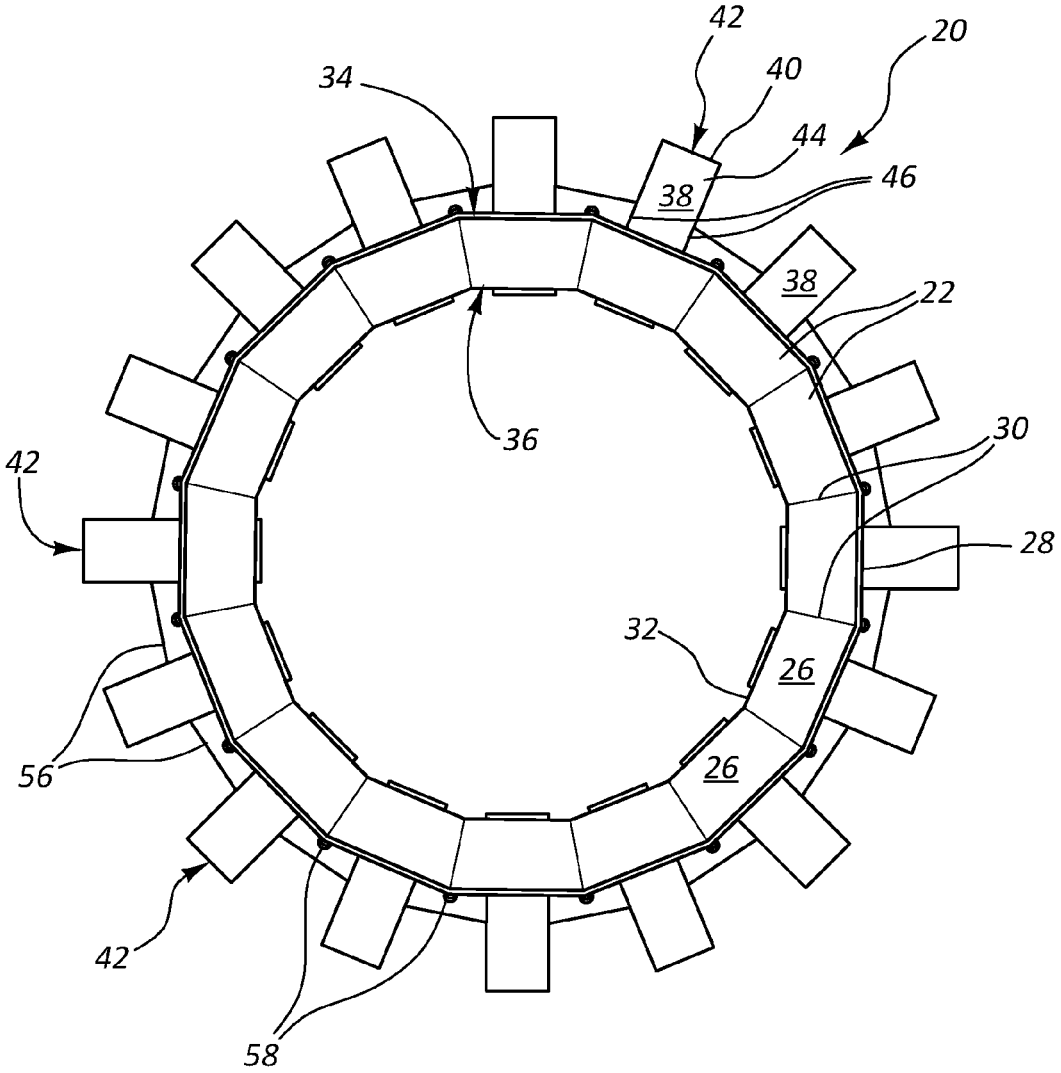
FIG. 5 is a top view of the roof ring.
Figure 6:
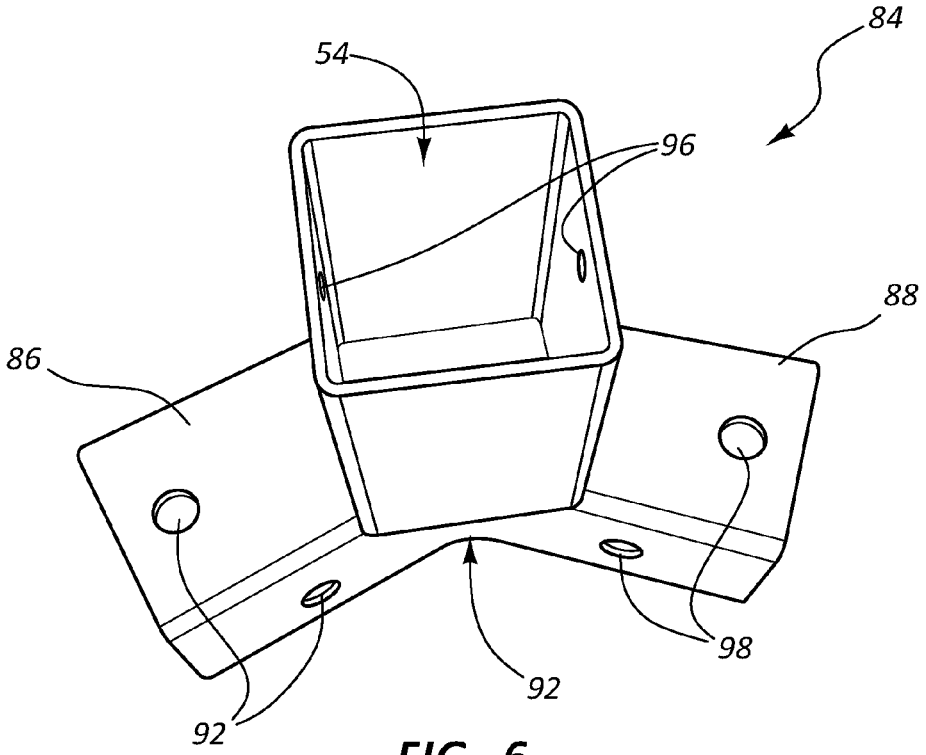
FIG. 6 is an elevation view of a base bracket.
Figure 7:
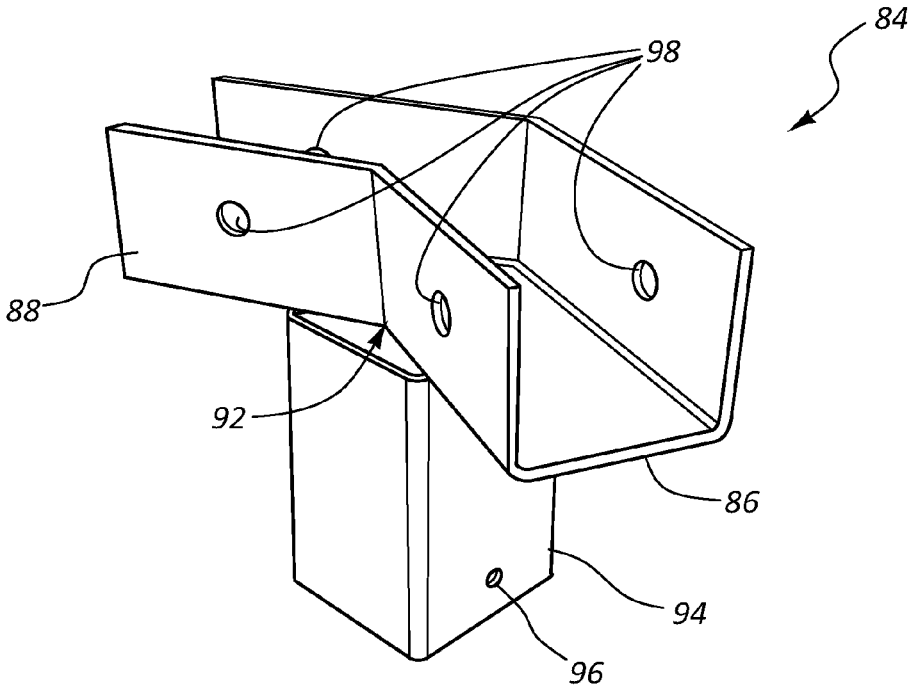
FIG. 7 is an inverted view of a base bracket.
Figure 8:
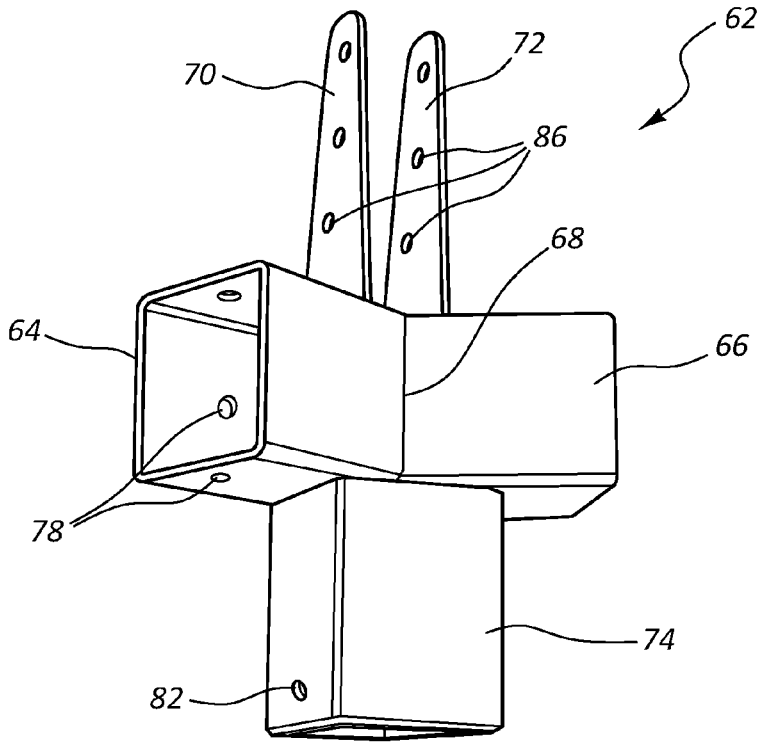
FIG. 8 is an isometric view of a top bracket.
Figure 9:
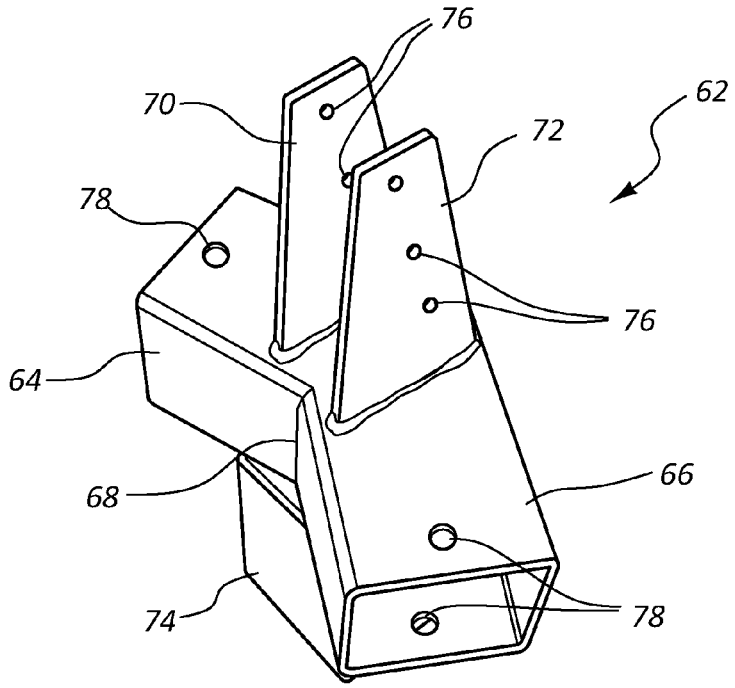
FIG. 9 is an elevation view of a top bracket.

With reference now to the drawings, and in particular FIGS. 1 through 9 thereof, example of the instant building assembly kit with roof ring employing the principles and concepts of the present building assembly kit with roof ring and generally designated by the reference number 10 will be described.

Referring to FIGS. 1 through 9 a preferred embodiment of the present building assembly kit with roof ring 10 is illustrated.

The present building assembly kit with roof ring 10 has been devised to enable rapid construction of a structure by fitting extant rafters 50 into a plurality of cuboid tube joints 38 disposed radially around a roof ring 20, thence interconnecting each of said rafters 50 at a top bracket 62 into a juncture of a respective pair of horizontally disposed wall top beams 60 and a vertically oriented corner post 80, and thence each corner post 80 at a juncture of a respective pair of base runners 90 at a base bracket 84.

The several parts of which the present building assembly kit with roof ring 10 is composed are configured to accurately align each of the rafters 50, wall top beams 60, corner posts 80, and base runners 90, into a congruent whole. The simplicity afforded construction with the present building assembly kit with roof ring 10 enables erection of a structure with few tools required. Each of the respective pieces of the present building assembly kit with roof ring 10 aligns and interconnects structural rafters 50, wall top beams 60, corner posts 80, and base runners 90 to provide stability and integration into a free standing structure for use, as desired.

The present building assembly kit with roof ring 10, therefore, includes a polygonal roof ring 20 disposed for positioning at the center of a roof. The roof ring 20 includes a plurality of wedge shaped facets 22 connected in the form of a polygon. Each of said wedge shaped facets 22 includes an outside face 24, an inside face 26, a first edge 28, a pair of converging edges 30, and a fourth edge 32 shorter than the first edge 28. Each of the wedge shaped facets 22 is joined at each converging edge 30 concentrically, and is thereby angularly disposed between an upper perimeter 34, formed by each first edge 28, and a lower perimeter 36, formed by each fourth edge 32. The upper perimeter 34 is therefore longer than the lower perimeter 36, and the polygonal roof ring 20 presents a sloped faceted surface, comprised of each facet outside face 24, therebetween.

Each of an open-ended plurality of hollow cuboid tube joints 38 is perpendicularly disposed upon each outside face 24 of each facet 22 of the roof ring 20. Each of said plurality of hollow cuboid tube joints 38 includes an open side 40 disposed in parallel with each respective facet 22 outside face 24, whereby a rafter pocket 42 is defined. The rafter pocket 42 is delimited between a top face 44, a pair of vertical faces 46, a bottom face 48, and a respective facet outside face 24. Each cuboid tube joint 38, disposed perpendicularly upon each facet 22 outside face 24, thus angles a rafter 50 inserted endwise into the rafter pocket 42 along a downward slope relative the roof ring 20.

An aperture 52 is disposed in the bottom face 48 of each cuboid tube joint 38 for insertion of a fastener 54 therethrough, whereby a rafter 50, inserted endwise into the rafter pocket 42, is secured to the respective tube joint 38.

Disposed between each of the plurality of cuboid tube joints 38 is each of a plurality of parallelepiped strut members 56. Each of said parallelepiped strut members 56 is disposed between adjacent tube joints 38, joined to the bottom faces 48 of respective adjacent hollow cuboid tube joints 38, and presents an angled surface atop which a rafter 50 may be secured. An aperture 58 is centrally disposed within each parallelepiped strut member 56, and a fastener 54 may be inserted therethrough to engage with a rafter 50 disposed endwise atop said strut member 56.

In the preferred embodiment herein disclosed, each of the plurality of hollow tube joints 38 is disposed spaced away from the upper perimeter 34 of the roof ring 20, whereby the bottom face 48 of each tube joint 38 is disposed overhanging the lower perimeter 36 of said roof ring 20. This enables a clear line of sight during installation of each of the plurality of rafters 50 into each of the hollow tube joints 38 to ensure each rafter 50 is inserted into the hollow tube joint 38 and abuts the respective wedge shaped facet 22 outside face 24.

Thus, when each of a plurality of rafters 50 has been inserted into each of the plurality of rafter pockets 42, and each of a plurality of rafters 50 has been secured to each of the plurality of parallelepiped strut members 56, a plurality of rafters 50 is secured radially projecting down slope from the roof ring 20. Each of the plurality of rafters 50 is now interconnectable at a juncture between two horizontally disposed wall top beams 60 by means of a top bracket 62.

Each top bracket 62 includes an open-ended hollow cuboid horizontal first beam pocket 64, an open-ended hollow cuboid horizontal second beam pocket 66 angularly disposed endwise upon the first beam pocket 64 at a pocket juncture 68, a right trapezoidal first rafter connect 70 disposed perpendicularly atop the first beam pocket 64, a right trapezoidal second rafter connect 72 disposed perpendicularly atop the second beam pocket 66 in parallel with the first rafter connect 70, and an open-ended hollow cuboid vertical beam pocket 74 disposed perpendicularly underlying the pocket juncture 68.

The second beam pocket 66 is disposed at an angle relative the first beam pocket 64 whereby wall top beams 60 inserted into each of said first and second beam pockets 64, 66 are angularly disposed relative each other in a horizontal plane. Each of the first and second rafter connects 70, 72 abut a side of a respective rafter 50 and is secure said rafter 50 therebetween. The rafter 50 thus abuts atop the pocket juncture 68 between each of the first and second rafter connects 70, 72. The vertical beam pocket 74 thence interconnects with a corner post 80 inserted therein. Each corner post 80, therefore, is disposed underlying a particular rafter 50 disposed atop the top bracket 62 pocket juncture 68.

To secure the respective rafter 50, pair of wall top beams 60, and corner post 80 at a relevant top bracket 62, a first plurality of fastener holes 76 is disposed in each of the first and second rafter connects 70, 72, a second plurality of fastener holes 78 is disposed in each of the first and second beam pockets 64, 66, and a third plurality of fastener holes 82 is disposed in the vertical beam pocket 74, through which first, second, and third plurality of fastener holes, 76, 78, 82, fasteners 54 are inserted to secure the relevant rafter 50, wall top beam 60, and corner post 80 in position.

Disposed at the base of each corner post 80 is a base bracket 84. Each base bracket 84 secures each corner post 80 to a respective pair of base runners 90, each of said base runners 90 disposed in parallel with each of the respective pair of wall top beams 60 disposed at the top of the relevant corner post 80. Each base bracket 84 includes a three-sided first base shoe 86 adapted to connect with a respective base runner 90 over three sides of said base runner 90, a three-sided second base shoe 88 disposed angularly endwise upon the three-sided first base shoe 86 at a base juncture 92, and an open-ended hollow vertical cuboid base pocket 94 perpendicularly disposed atop the base juncture 92.

Thus, each of a pair of respective base runners 90 are secured at the base juncture 92 by means of each of the first and second base shoes 86, 88 and a relevant corner post 80 is secured atop the base juncture 92 within the respective base pocket 94. A fourth plurality of fastener holes 96 is disposed in the base pocket 94 for interconnection with the relevant corner post 80, and a fifth plurality of fastener holes 98 is disposed in the first and second base shoes 86, 88 to secure each of the pair of respective base runners 90 at the base juncture 92.

Thus the roof ring 20 supportively articulates a plurality of extant rafters 50 radially around an open center, each of the plurality of top brackets 62 connects each rafter 50 endwise atop the juncture of a plurality of wall top beams 60, the plurality of base brackets 84 secures a plurality of base runners 90 underlying a plurality of corner posts 80 vertically disposed between the plurality of runners 90 and the plurality of wall top beams 60, and a building is expediently erected. The roof ring 20, the plurality of top brackets 62, and the plurality of base brackets 84 maintain correct alignment and interconnection of the plurality of rafters 50, the plurality of wall top beams 60, the corner posts 80, and the base runners 90 to supportively integrate and uphold a resulting structure within a minimum of tools required.

What is claimed is:

1. A building assembly kit with roof ring having an open-ended plurality of hollow cuboid tube joints radially disposed around an open center of a roof ring and a plurality of parallelepiped strut members disposed between each of the plurality of cube joints, said cube joints and plurality of strut members disposed to interconnect endwise with a plurality of extant rafters, said rafters positioned angularly relative the roof ring, each of said rafters interconnecting with a plurality of top brackets disposed to interconnect each of said rafters at a juncture between a pair of horizontally disposed extant wall top beams and a vertically oriented corner post, said corner post connected at a juncture of a pair of base runners by a base bracket, wherein a structure is expediently erected by inserting each rafter, wall top beam, corner post, and base runner into a corresponding tube joint, top bracket, and base bracket.

2. The building assembly kit with roof ring of claim 1 wherein the roof ring further comprises a plurality of wedge shaped facets having an outside face, an inside face, a first edge, a pair of converging edges, and a second edge shorter than the first edge, wherein each of said wedge shaped facets is joined at each converging edge concentrically, there angularly disposed between an upper perimeter formed by each first edge, and a lower perimeter formed by each fourth edge whereby each of the plurality of tube joints is disposed normal on each outside face.

3. The building assembly kit with roof ring of claim 2 wherein each of the open-ended plurality of hollow tube joints further comprises an open side disposed in parallel with each respective facet outside face to define a rafter pocket delimited between a top face, a pair of vertical faces, a bottom face, and a respective facet outside face, said tube joint further comprising at least one aperture therein wherein a fastener is insertable to engage a rafter disposed endwise into said rafter pocket.

4. The building assembly kit with roof ring of claim 3 wherein each of the plurality of strut members is joined between respective bottom faces of adjacent tube joints, each of said plurality of strut members including at least one aperture disposed therein whereby a fastener is insertable to engage with a rafter disposed endwise upon said strut member.

5. The building assembly kit with roof ring of claim 4 wherein each of the plurality of top brackets further comprises:

an open-ended hollow cuboid horizontal first beam pocket;

an open-ended hollow cuboid horizontal second beam pocket angularly disposed endwise upon the first hollow cuboid horizontal beam pocket at a pocket juncture, said second hollow cuboid horizontal beam pocket disposed at an angle relative the first hollow cuboid horizontal beam pocket;

a right trapezoidal first rafter connect disposed perpendicularly atop the first hollow cuboid horizontal beam pocket;

a right trapezoidal second rafter connect disposed perpendicularly atop the second hollow cuboid horizontal beam pocket in parallel with the right trapezoidal first rafter connect;

an open-ended hollow cuboid vertical beam pocket disposed perpendicularly underlying the pocket juncture;

a first plurality of fastener holes disposed in each of the first and right trapezoidal second rafter connects;

a second plurality of fastener holes disposed in each of the first and second hollow cuboid horizontal beam pockets; and a third plurality of fastener holes disposed in the hollow cuboid vertical beam pocket;

wherein each of the first and second trapezoidal rafter connects adjacently abut an extant rafter disposed therebetween, said rafter stabilized upon the respective top bracket between each of said first and second trapezoidal rafter connects by means of fasteners inserted through each of the first plurality of fastener holes, each of the first and second cuboid horizontal beam pockets interconnect adjacent horizontally disposed wall top beams at the pocket juncture underlying said respective rafter, and the vertical beam pocket interconnects a vertically oriented corner post thereunder.

6. The building assembly kit with roof ring of claim 5 wherein each of the plurality of base brackets comprises:

a three-sided first base shoe;

a three-sided second base shoe disposed angularly endwise upon the three-sided first base shoe, said three-sided second base shoe disposed at an angle relative the three-sided first base shoe at a base juncture;

an open-ended hollow vertical cuboid base pocket perpendicularly disposed atop the base juncture;

a fourth plurality of fastener holes disposed within the hollow vertical cuboid base pocket; and a fifth plurality of fastener holes disposed in the first and second three-sided base shoes;

wherein the vertical cuboid base pocket interconnects a respective corner post at the base juncture and each of the first and second three-sided base shoes overlies a horizontally disposed base runner joined endwise at an angle at the base juncture.

7. The building assembly kit with roof ring of claim 6 wherein each of the plurality of hollow tube joints is disposed spaced away from the upper perimeter of the roof ring whereby the bottom face of each tube joint is disposed overhanging the lower perimeter of said roof ring.

8. A building assembly kit with roof ring comprising:

a polygonal roof ring comprising:

each of a plurality of wedge shaped facets having an outside face, an inside face, a first edge, a pair of converging edges, and a fourth edge shorter than the first edge, each of said wedge shaped facets joined at each converging edge concentrically and angularly disposed between an upper perimeter, formed by each first edge, and a lower perimeter, formed by each fourth edge;

each of an open-ended plurality of hollow cuboid tube joints perpendicularly disposed upon each outside face, each of said plurality of hollow cuboid tube joints having an open side disposed in parallel with each respective facet outside face to define a rafter pocket delimited between a top face, a pair of vertical faces, a bottom face and a respective facet outside face;

an aperture disposed in the bottom face of each hollow cuboid tube joint;

each of a plurality of parallelepiped strut members disposed between adjacent hollow cuboid tube joints, each of said parallelepiped strut members joined to the bottom faces of respective adjacent hollow cuboid tube joints;

an aperture centrally disposed within each parallelepiped strut member;

each of a plurality of top brackets comprising:

an open-ended hollow cuboid horizontal first beam pocket;

an open-ended hollow cuboid horizontal second beam pocket angularly disposed endwise upon the first beam pocket at a pocket juncture, said second beam pocket disposed at an angle relative the first hollow cuboid horizontal beam pocket;

a right trapezoidal first rafter connect disposed perpendicularly atop the first hollow cuboid horizontal beam pocket;

a right trapezoidal second rafter connect disposed perpendicularly atop the second hollow cuboid horizontal beam pocket in parallel with the right trapezoidal first rafter connect;

an open-ended hollow cuboid vertical beam pocket disposed perpendicularly underlying the pocket juncture;

a first plurality of fastener holes disposed in each of the first and right trapezoidal second rafter connects;

a second plurality of fastener holes disposed in each of the first and second hollow cuboid horizontal beam pockets;

a third plurality of fastener holes disposed in the hollow cuboid vertical beam pocket;

each of a plurality of base brackets comprising:

a three-sided first base shoe;

a three-sided second base shoe disposed angularly endwise upon the three-sided first base shoe, said three-sided second base shoe disposed at an angle relative the three-sided first base shoe at a base juncture;

an open-ended hollow vertical cuboid base pocket perpendicularly disposed atop the base juncture;

a fourth plurality of fastener holes disposed within the hollow vertical cuboid base pocket; and a fifth plurality of fastener holes disposed in the first and second three-sided base shoes;

wherein the roof ring supportively articulates a plurality of extant rafters radially around an open center, each of the plurality of top brackets connects each rafter endwise atop the juncture of a plurality of wall top beams, the plurality of base brackets secures a plurality of base runners underlying a plurality of corner posts vertically disposed between the plurality of runners and the plurality of wall top beams, whereby a building is expediently erected and the roof ring, the plurality of top brackets, and the plurality of base brackets maintain correct alignment and interconnection of the plurality of rafters, the plurality of wall top beams, the corner posts, and the base runners to supportively integrate and uphold a resulting structure.

9. The building assembly kit with roof ring of claim 8 wherein each of the plurality of hollow tube joints is disposed spaced away from the upper perimeter of the roof ring whereby the bottom face of each tube joint is disposed overhanging the lower perimeter of said roof ring.

* * * * *